US008696537B2

(12) United States Patent
Cline et al.

(10) Patent No.: US 8,696,537 B2
(45) Date of Patent: Apr. 15, 2014

(54) SINGLE-FOLD INTERFOLDING MACHINE WITH ABILITY TO PRODUCE OFF-FOLDED TOWEL OR TISSUE PRODUCTS

(75) Inventors: Curtis Cline, Washburn, WI (US); Greg M. Kauppila, Ashland, WI (US)

(73) Assignee: C.G. Bretting Manufacturing Co., Inc., Ashland, WI (US)

( * ) Notice: Subject to any disclaimer, the term of this patent is extended or adjusted under 35 U.S.C. 154(b) by 745 days.

(21) Appl. No.: 12/706,503

(22) Filed: Feb. 16, 2010

(65) Prior Publication Data

US 2011/0201486 A1 Aug. 18, 2011

(51) Int. Cl.
*B65H 45/24* (2006.01)

(52) U.S. Cl.
CPC ..... *B65H 45/24* (2013.01)
USPC ..... 493/433; 270/39.06

(58) Field of Classification Search
CPC ..... B65H 45/20; B65H 45/24
USPC ..... 493/359, 417, 418, 424, 427, 433, 434, 493/435, 442, 430; 270/39, 39.06, 39.07, 270/39.08, 39.09
See application file for complete search history.

(56) References Cited

U.S. PATENT DOCUMENTS

| | | | | |
|---|---|---|---|---|
| 1,141,395 | A | 6/1915 | Johnston et al. | |
| 1,219,238 | A * | 3/1917 | Brown et al. | 270/39.09 |
| 3,489,406 | A * | 1/1970 | Nystrand | 270/39.09 |
| 4,279,411 | A * | 7/1981 | Nystrand | 493/433 |
| 4,691,908 | A * | 9/1987 | Bradley | 270/21.1 |
| 4,778,441 | A * | 10/1988 | Couturier | 493/425 |
| 4,917,665 | A | 4/1990 | Couturier | |
| 5,000,729 | A * | 3/1991 | Yamauchi | 493/359 |
| 5,088,707 | A * | 2/1992 | Stemmler | 270/39.02 |
| 5,147,273 | A | 9/1992 | Rottmann et al. | |
| 5,310,398 | A | 5/1994 | Yoneyama | |
| 5,899,447 | A | 5/1999 | Muckenfuhs | |
| 6,431,038 | B2 | 8/2002 | Couturier | |
| 6,623,833 | B2 | 9/2003 | Chan | |
| 6,708,855 | B2 | 3/2004 | Wilson et al. | |
| 7,517,309 | B2 | 4/2009 | De Matteis | |
| 2006/0063657 | A1 | 3/2006 | St. Germain et al. | |
| 2007/0082801 | A1 * | 4/2007 | Kauppila et al. | 493/435 |
| 2007/0197365 | A1 | 8/2007 | De Matteis | |
| 2007/0203007 | A1 | 8/2007 | De Matteis | |

FOREIGN PATENT DOCUMENTS

| | | | |
|---|---|---|---|
| EP | 1514677 | A1 | 3/2005 |
| WO | WO 2007/031971 | A2 | 3/2007 |

* cited by examiner

*Primary Examiner* — Stephen F Gerrity
(74) *Attorney, Agent, or Firm* — Reinhart Boerner Van Deuren P.C.

(57) ABSTRACT

A method and apparatus are provided, for forming a stack of interfolded sheets of porous material including a leading panel having a partial-panel width joined along a fold line to a trailing panel having a full-panel width, by controlling the position of leading edges of the sheets both upstream and downstream from the nip between the interfolding rolls of the folding machine with vacuum applied through corresponding vacuum ports disposed in the periphery of the folding rolls at circumferential distances equal to the partial panel length ahead of each gripper and tucker in the direction of rotation. Sufficient suction is applied to hold both the leading edge of the leading panel of a given sheet and an underlying portion of the trailing panel of the immediately preceding sheet against the periphery of one of the other of the rolls downstream from the nip.

32 Claims, 7 Drawing Sheets

SINGLE-FOLD INTERFOLDING MACHINE WITH ABILITY TO PRODUCE OFF-FOLDED TOWEL OR TISSUE PRODUCTS

FIELD OF THE INVENTION

This invention relates generally to a method and apparatus for providing stacks of interfolded single folded sheets, and more particularly to providing stacks of interfolded sheets having a single full-width panel joined along a fold line to a single partial-width panel using an interfolding apparatus having interacting grippers and tuckers circumferentially-spaced around the peripheries of a pair of folding rolls at the full panel width.

BACKGROUND OF THE INVENTION

There are many products, such as paper towels, napkins and tissues, which are sold in the form of single-folded sheets having a first and second panel A, B joined along a common edge of the panels at a fold line C, in the manner illustrated in FIG. 1. As further illustrated in FIG. 1, such single-folded sheets are often provided in an interfolded stack of sheets, with the first panel of each sheet overlapping the second panel of a successive sheet. By virtue of this arrangement, the interfolded stack of sheets can be dispensed from a dispenser having a sheet stack receptacle width equal to the full width of the first and second panels A, B, with the dispenser further having an opening at one end thereof through which the individual sheets may be dispensed, one-at-a-time, by pulling on an exposed panel extending out of the opening. As each sheet is pulled out of the dispenser, by grasping the first panel A and pulling, the interfolding of the second panel of the first sheet with the first panel of the second sheet causes the first panel of the second sheet to be pulled through the opening in the dispenser and left exposed for use in pulling the next sheet from the dispenser.

Such interfolded stacks of single-folded sheets are often formed with an interfolding apparatus having a pair of count-rotating folding rolls mounted to form a nip between the rolls through which partly-overlapped sheets cut from two separate webs of material are fed to form the interfolded stack. The rolls of such folding machines typically include a plurality of grippers and coordinating tuckers alternately circumferentially spaced at a circumferential difference from one another which is substantially equal to the full panel width of the interfolded sheets. The rolls are operatively connected to counter-rotate in a timed relationship to one another such that the grippers from each roll interact with respective tuckers from the other roll as the coordinating grippers and tuckers pass through the nip. Such an apparatus, and a method for operating such an apparatus, are described in U.S. Pat. No. 5,147,273 to Rottman.

It will be noted that, in a stack of interfolded sheets such as the one illustrated in FIG. 1, the leading and trailing edges of an immediately following and immediately preceding sheet are folded into a given sheet substantially at the fold line of the given sheet. Accordingly, one could refer to the positioning of the leading and trailing edges of the sheets as being "on-fold."

Machines of this type, and prior methods for their use, have proved to work very well for high-speed production of interfolded stacks of sheets having two identical full width panels joined along a common fold line. During operation of such machines, each sheet is typically grasped by the grippers at both a leading and a trailing edge of the sheet and at the fold line, as the overlapped sheets make their way along a portion of the peripheries of the folding rolls and pass through the nip.

Although single-folded sheets of product having two full-width panels have been widely accepted for many uses through the years, there is now a desire in the marketplace for stacks of interfolded single-folded sheets having one full-width panel E joined along the fold line F to a partial-width panel D in the manner shown in FIG. 2. Because the leading edge of the partial-width leading panel D is not positioned at the fold line F, in a stack of interfolded sheets of the type shown in FIG. 2, such a stack of sheets may be referred to as being "off-fold," or "off-folded."

Having one panel be shorter also conserves valuable natural resources, and reduces the cost per sheet, while still allowing the use of existing dispensers configured to dispense single-folded products having two full-width panels.

It is desirable to produce such stacks of interfolded sheets having one full-width and one partial-width panel utilizing interfolding machinery and methods similar to those having proven to be so successful at high-speed production of interfolded stacks of single-folded sheets having two full-width panels, such as those described above and in the U.S. Pat. No. 5,147,273 patent to Rottman cited above. It would also be highly desirable to be able to manufacture either the traditional interfolded stacks of single-folded sheets having two full-width panels, and, alternatively, inter-folded stacks of single-fold sheets having one full-width and one partial-width panel on the same interfolding machine.

In order to make interfolded stacks of single-fold sheets having one full-width and one partial-width panel on a conventional interfolding machine having grippers and tuckers spaced at circumferential distances equal to a full-panel width, a substantial problem must be overcome. When the sheets having one partial-width panel are run through the machine, the grippers and tuckers cannot be used to grasp one end or the other of the sheet. Providing a method and apparatus for controlling the end of the sheet adjacent the partial panel presents a considerable technical challenge. The end of the partial-width panel falling between adjacent tuckers and grippers cannot be allowed to hang free as the sheet interacts with the folding roll during high-speed operation. An uncontrolled free-hanging edge would lead to mis-folded product, and other problems such as jamming of the interfolder or damage to the interfolder, thus precluding operation at the high production speeds necessary to keep the interfolded products at a low enough cost to compete in the marketplace.

A need exists in the industry, therefore, to provide a method and apparatus for producing off-folded towel or tissue products, and the like, in a single-fold interfolding machine having grippers and tuckers circumferentially spaced around the folding rolls at a full-panel circumferential distance. It is also highly desirable to provide such a method and apparatus in a form which will allow production of both traditional single-folded sheets having two identical panels, and off-folded products having a full-width panel and a partial-width panel in a single interfolding machine.

BRIEF SUMMARY OF THE INVENTION

The invention provides a method and apparatus for forming a stack of interfolded sheets of porous material including a leading panel having a partial-panel width joined along a fold line to a trailing panel having a full-panel width, by controlling the position of leading edges of the sheets both upstream and downstream from the nip between the interfolding rolls of the folding machine with vacuum applied through corresponding vacuum ports disposed in the periphery of the folding rolls at circumferential distances equal to the partial panel length ahead of each gripper and tucker in the direction of rotation.

In some forms of the invention, the sheets may consist of only the leading and trailing panels joined at the fold line. In some forms of the invention, the sheets may consist of a layer formed of only a single ply of material. In other forms of the invention, the sheets may have layers of multiple plys, either folded or not folded.

In some forms of the invention, the circumferential spacing of the vacuum port from the grippers and tuckers is variable from at least a first to a second circumferential spacing, to thereby accommodate production of interfolded sheets having at least a first partial-panel width and sheets having a second partial-panel width. The vacuum ports may be defined by plates which are alternatively attachable to the rolls, for changing the circumferential spacing of the vacuum ports with respect to the grippers and tuckers.

Some forms of the invention may also include a sheet cutting arrangement for feeding the sheets to the interfolding rolls in such a manner that the sheets overlap one another by a distance equal to the partial panel width. Such a sheet-cutting arrangement may provide sheets having an overall width equal to the sum of the full-panel width and the partial-panel widths.

In some forms of the invention, the grippers are configured and operatively connected for grasping the sheets only at the fold line and at a trailing edge of the trailing panel of each sheet, when providing a stack of interfolded sheets with leading panels having a partial-panel width joined to a trailing panel having a full-panel width.

In some forms of the invention, the leading edge of the sheets downstream from the nip are controlled by applying sufficient suction for holding both the leading edge of the leading panel of a given sheet and an underlying portion of the trailing panel of the immediately previous sheet against the periphery of one of the other of the rolls downstream from the nip.

In some forms of the invention, the same interfolding machine may be utilized for providing stacks of interfolded sheets having a full-width leading panel joined to a full-width trailing panel, and alternately for forming interfolded stacks of sheets having a partial-width leading panel joined to a full-width trailing panel. When forming a stack of interfolded sheets having full-width leading and trailing panels, vacuum ports are actuated adjacent the tuckers for controlling the leading edge of the leading panel. When forming an interfolded stack of sheets having a partial-width leading panel joined to a full-width trailing panel, the leading edges of the sheets are controlled by vacuum ports disposed in the periphery of the first and second folding rolls at a circumferential distance equal to the partial panel length, ahead of each gripper and tucker in the direction of rotation.

In one form of the invention, a method is provided for using an apparatus, including a pair of counter-rotating folding rolls having respective peripheries thereof defining a nip between the rolls and having cooperating grippers and tuckers alternately circumferentially spaced around the peripheries of the rolls at the full-panel width. The rolls are operatively connected for counter rotation in a timed relationship to one another such that the grippers from each roll interface cooperatively with respective tuckers from the other roll at the nip to form a stack of interfolded sheets of porous material including a leading panel having a partial panel width less than the full-panel width joined along a fold line to a trailing panel having a full-panel width. The sheets define a trailing edge of the trailing panel and a leading edge of the leading panel spaced from the fold line at the full-panel width and a partial-panel width, respectively. The position of the leading edges of the sheets both upstream and downstream from the nip is controlled with vacuum applied through corresponding vacuum ports disposed in the periphery of the first and second folding rolls at a circumferential distance equal to the partial-panel length ahead of each gripper and tucker in the direction of rotation.

The invention may include selectively applying vacuum to, and removing vacuum from, the vacuum ports located at the partial-panel circumferential distance ahead of each gripper and tucker in such a manner that, the leading edge of the leading panel of each sheet is first held directly against the periphery of one or the other of the rolls by a vacuum port disposed ahead of a gripper as the leading edge of the leading panel approaches the nip, and is then such that the leading edge held by a vacuum port disposed ahead of a tucker of the other roll of the one or the other rolls against a radially outer surface of an underlying trailing panel of an immediately preceding sheet resting on the periphery of the other roll as the leading edge of the leading panel moves away from the nip. The invention may also include removing vacuum from the vacuum port holding both the leading edge of the leading panel of a given sheet and an underlying portion of the trailing panel of the immediately previous sheet against the periphery of the roll downstream from the nip, at a desired angular position beyond the nip in the direction of rotation of the vacuum port holding both the leading edge of the leading panel of a given sheet and the underlying portion of the trailing panel of the immediately previous sheet against the periphery of the roll downstream from the nip.

Positioning of the leading edges of the sheets downstream from the nip may include applying sufficient suction for to hold both the leading edge of the leading panel of a given sheet and an underlying portion of the trailing panel of the immediately previous sheet against the periphery of one or the other of the rolls downstream from the nip.

Some forms of the invention may include transferring the leading edge to the other roll substantially as corresponding vacuum ports in the first and second folding rolls pass through the nip in substantially juxtaposition to one another, by the process of:

(a) removing vacuum from the one or the other of the folding rolls to release the leading edge from the periphery of the one or the other of the folding rolls, substantially as corresponding vacuum ports in the first and second folding rolls pass through the nip in substantial juxtaposition to one another; and then (b) supplying sufficient vacuum to the vacuum port in the other of the one or the other folding rolls for holding both the leading edge of the leading panel of a given sheet and an underlying portion of the trailing panel of the immediately previous sheet against the periphery of the other of the one or the other folding rolls downstream from the nip.

The invention may take the form of an apparatus for forming a stack of interfolded sheets of porous material including a trailing panel having a full panel width joined along a fold line to a leading panel having a partial-panel width that is less than the full-panel width, where the sheets define a trailing edge of the trailing panel and the sheet and a leading edge of the leading panel end of the sheet spaced from the fold line by the full-panel width and the partial-panel width, respectively. Such an apparatus may include a pair of counter-rotating folding rolls and a control arrangement. The folding rolls have respective peripheries thereof defining a nip between the rolls and having cooperating grippers and tuckers alternately circumferentially spaced about the peripheries of the rolls at the full-panel width. The rolls are operatively connected for counter-rotation in a timed relationship to one another, such that the grippers from each roll interface cooperatively with respective tuckers from the other roll at the nip. The control arrangement may be configured and operatively connected for positioning the leading edges of the sheets both upstream and downstream from the nip, using vacuum applied through corresponding vacuum ports disposed in the periphery of the first and second folding rolls at a circumferential distance equal to the partial panel length ahead of each gripper and tucker in the direction of rotation.

A control arrangement, according to the invention, may be further configured and operatively interconnected for positioning the leading edges of the sheets downstream from the nip by applying sufficient suction for holding both the leading edge of the leading panel of a given sheet and an underlying portion of the trailing panel of the immediately-previous sheet against the periphery of one or the other of the rolls downstream from the nip.

A control arrangement according to the invention may be further configured and operatively interconnected for transferring the leading edge to the other rolls substantially as corresponding vacuum ports in the first and second folding rolls pass through the nip in substantial juxtaposition to one another, by the process of:

(a) removing vacuum from the one or the other of the folding rolls to release the leading edge from the periphery of the one or the other of the folding rolls, substantially as corresponding vacuum ports in the first and second folding rolls pass through the nip in substantial juxtaposition to one another; and then (b) supplying sufficient vacuum to the vacuum port in the other of the one or the other folding rolls for holding both the leading edge of the leading panel of a given sheet and an underlying portion of the trailing panel of the immediately previous sheet against the periphery of the other of the one or the other folding rolls downstream from the nip.

A control arrangement, according to the invention, may be further configured and operatively connected to remove vacuum from the vacuum port holding both the leading edge of the leading panel of a given sheet and an underlying portion of the trailing portion of the immediately previous sheet against the roll downstream from the nip. Vacuum may be removed from the port holding both the leading edge of the leading panel of the given sheet and the underlying portion of the trailing panel of the immediately previous sheet against the periphery of the roll downstream from the nip when the vacuum port reaches a desired angular position beyond the nip in the direction of rotation of the vacuum port, to thereby release the leading edge and underlying sheet so that the interfolded panels can move toward and come to rest against the previously-completed portions of the stack of interfolded sheets.

One form of an apparatus, according to the invention, includes first and second folding rolls each having vacuum ports, and a control arrangement for selectively controlling application of vacuum to the vacuum ports, for interfolding sheets of porous material fed alternately from two sheet streams, to form a stack of interfolded sheets each having a leading panel and a trailing panel joined to one another along a fold line, with the sheets being folded such that the trailing panel defines a full-panel width and the leading panel has a partial-panel width that is less than the full-panel width. The first and second folding rolls define respective peripheries thereof, and are mounted for rotation about respective substantially parallel first and second roll axes to form a nip between the rolls for passage therethough of the sheets along a sheet path extending through the nip. Each of the first and second folding rolls also has at least one gripper and at least one tucker alternately circumferentially spaced at a circumferential distance from one another substantially equal to the full-panel widths. The rolls are operatively connected for counter-rotation in a timed relationship to one another such that the grippers from each roll interface cooperatively with respective tuckers from the other roll at the nip. The vacuum ports are disposed in the periphery of the first and second folding rolls a circumferential distance equal to the partial panel length ahead of each gripper and tucker in the direction of rotation.

The control arrangement is configured and operatively connected for selectively applying and removing vacuum to the vacuum ports in such a manner that the leading edge of the leading panel of each sheet is first held directly against the periphery of one or the other of the rolls by a vacuum port disposed ahead of the gripper as the leading edge of the leading panel approaches the nip. The leading edge of the leading panel of each sheet is then transferred to and held by a vacuum port disposed ahead of the tucker of the other roll of the one or the other rolls, against a radially outer surface of an underlying trailing panel of an immediately preceding sheet resting on the periphery of the other roll as the leading edge of the leading panel approaches and then passes through the nip.

The control arrangement applies sufficient vacuum for holding the leading edges of the sheets directly against the periphery of one or the other of the folding rolls upstream from the nip. The control arrangement then causes the leading edge to transfer to the other of the one or the other folding rolls substantially as corresponding vacuum ports in the first and second folding rolls pass through the nip in substantial juxtaposition to one another by the process of:

(a) removing vacuum from the one or the other of the folding rolls to release the leading edge from the periphery of the one or the other of the folding rolls, substantially as corresponding vacuum ports in the first and second folding rolls pass through the nip in substantial juxtaposition to one another; and then (b) supplying sufficient vacuum to the vacuum port in the other of the one or the other folding rolls for holding both the leading edge of the leading panel of a given sheet and an underlying portion of the trailing panel of the immediately previous sheet against the periphery of the other of the one or the other folding rolls downstream from the nip.

The control arrangement may be further configured and operatively connected to remove vacuum from the vacuum port holding both the leading edge of the leading panel of a given sheet and the underlying portion of the trailing panel of the immediately preceding sheet against the periphery of the roll downstream from the nip. The control arrangement may be configured and connected to remove vacuum from this port at a desired angular position beyond the nip in the direction of rotation of this port downstream from the nip.

In various forms of the invention, a controller may be configured and operatively connected for selectively applying and removing vacuum at the vacuum ports as a function of angular position of the vacuum ports with respect to the nip. A method, according to the invention, may include the step of alternative feeding sheets having a total length equal to the sum of the full and partial panel widths from a first and a second sheet stream through a nip, in such a manner that successive sheets overlap by the partial panel width. The sheets may be grasped with the grippers only along the fold line and trailing edges of the sheets. Vacuum may be selectively applied to and removed from vacuum ports disposed in the periphery of the first and second folding rolls at a circumferential distance equal to the partial panel length, ahead of each gripper and tucker in the direction of rotation, in such a manner that the leading edge of the leading panel of each sheet is first held directly against the periphery of one or other of the rolls by a vacuum port disposed ahead of a gripper as the leading edge of the leading panel approaches the nip. Vacuum may then be selectively applied to and removed from the vacuum ports in such a manner that the leading edge of the sheet is transferred to and held by a vacuum port disposed ahead of a tucker of the other roll of the one or the other rolls against a radially outer surface of an underlying trailing panel of an immediately preceding sheet resting on the periphery of the other roll as the leading edge of the leading panel moves away from the nip.

A method, according to the invention, may further include removing the vacuum from the vacuum port holding both the leading edge of the leading panel of the given sheet and the underlying portion of the trailing panel of the immediately preceding sheet against the periphery of the roll downstream from the nip, at a desired angular position beyond the nip in the direction of rotation of the vacuum port holding both the leading edge of the leading panel of the given sheet and the underlying portion of the trailing panel of the immediately preceding sheet against the periphery of the roll downstream from the nip.

A method, according to the invention, may further include transferring the leading edge to the other roll substantially as corresponding vacuum ports in the first and second folding rolls pass through the nip in substantial juxtaposition to one another, by the process of:

(a) removing vacuum from the one or the other of the folding rolls to release the leading edge from the periphery of the one or the other of the folding rolls, substantially as corresponding vacuum ports in the first and second folding rolls pass through the nip in substantial juxtaposition to one another; and then (b) supplying sufficient vacuum to the vacuum port in the other of the one or the other folding rolls for holding both the leading edge of the leading panel of a given sheet and an underlying portion of the trailing panel of the immediately previous sheet against the periphery of the other of the one or the other folding rolls downstream from the nip.

The invention may also take the form of a method or apparatus for providing stacks of interfolded sheets having a leading panel and a trailing panel joined at a fold line with the leading and trailing panels both having a full-panel width, and alternatively for providing stacks of interfolded sheets of porous material having a leading panel and a trailing panel joined at a fold line with the leading panel having a partial-panel width that is less than the full-panel width. In either the mode of operation for providing sheets having leading and trailing panels both of a full-panel width, or for providing panels having a trailing panel of full width and a leading panel of partial width, the sheets define a leading edge of the leading panel thereof and the sheet, and a trailing edge of the trailing panel thereof and the sheet, regardless of the width of the leading and trailing panels.

Such a dual-mode apparatus, according to the invention, may include first and second folding rolls each having vacuum ports, and a control arrangement for selectively controlling application of vacuum to the vacuum ports. The first and second folding rolls may define respective peripheries thereof and be mounted for rotation about respectively substantial parallel first and second roll axes, to form a nip between the rolls for passage therethrough of the sheets along a sheet path extending through the nip. Each of the first and second folding rolls may have at least one gripper and at least one tucker alternately circumferentially spaced at a circumferential distance from one another substantially equal to the full panel width. The rolls may be operatively connected for counter-rotation in a timed relationship with one another, such that the grippers from each roll interface cooperatively with respective tuckers from the other roll at the nip.

The vacuum ports, control arrangement and grippers are selectively configurable and operatively connectable such that when the apparatus is providing interfolding sheets having leading and trailing panels both equal to the full panel width, the control arrangement provides vacuum to the vacuum ports located adjacent the tuckers for holding the leading edge of the leading panel against the periphery of the folding rolls upstream from the nip, such that the grippers may grasp each sheet at the fold line, the trailing edge and the leading edge thereof.

The vacuum ports, control arrangement and grippers are further alternatively selectively configurable and operatively connectable such that when the apparatus is providing interfolded sheets having the trailing panel equal to the full-panel width and the leading panel equal to the partial-panel width:

(a) the grippers grasp the sheets only at the fold line and at a trailing edge of the trailing panel of each sheet; and (b) the control arrangement selectively applies vacuum to, and removes vacuum from, vacuum ports disposed in the periphery of the first and second folding rolls at a circumferential distance equal to the partial panel length ahead of each gripper and tucker in the direction of rotation in such a manner that the leading edge of the leading panel of each sheet is first held directly against the periphery of one or the other of the rolls by a vacuum port disposed ahead of a gripper as the leading edge of the leading panel approaches the nip and is then held by a vacuum port disposed ahead of a tucker of the other roll of the one or the other rolls against a radially outer surface of an underlying trailing panel of an immediately preceding sheet resting on the periphery of the other roll as the leading edge of the leading panel moves away from the nip.

When such a dual-mode apparatus is providing sheets of porous material with the leading panel having a partial panel width, the control arrangement may be further configured and operatively connected to remove vacuum from the vacuum port holding both the leading edge of the leading panel of a given sheet and the underlying portion of the trailing panel of the immediately preceding sheet against the periphery of the roll downstream from the nip, at a desired angular position beyond the nip in the direction of rotation of the vacuum port holding both the leading edge of the leading panel of the given sheet and the underlying portion of the trailing panel of the immediately previous sheet against the periphery of the roll downstream from the nip.

When such a dual-mode of apparatus is providing sheets of porous material with the leading panel having a partial-panel width, the control arrangement may selectively apply and remove vacuum from the vacuum ports of the folding rolls in such a manner that the leading edges of the sheets are held directly against the periphery of one or the other of the folding rolls upstream from the nip, and are then transferred to the other of the one or the other folding rolls substantially as corresponding vacuum ports in the first and second folding rolls pass through the nip in substantial juxtaposition to one another, by the process of:

(a) removing vacuum from the one or the other of the folding rolls to release the leading edge from the periphery of the one or the other of the folding rolls, substantially as corresponding vacuum ports in the first and second folding rolls pass through the nip in substantial juxtaposition to one another; and then (b) supplying sufficient vacuum to the vacuum port in the other of the one or the other folding rolls for holding both the leading edge of the leading panel of a given sheet and an underlying portion of the trailing panel of the immediately previous sheet against the periphery of the other of the one or the other folding rolls downstream from the nip.

When the apparatus is providing sheets of porous material with the leading panel having a partial panel width, the control arrangement is further configured and operatively connected to remove vacuum from the vacuum port holding both the leading edge of the leading panel of a given sheet and an underlying portion of the trailing panel of the immediately previous sheet against the periphery of the roll downstream from the nip, at a desired angular position beyond the nip in the direction of rotation of the vacuum port holding both the leading edge of the leading panel of a given sheet and an underlying portion of the trailing panel of the immediately previous sheet against the periphery of the roll downstream from the nip.

In a dual mode apparatus, according to the invention, the circumferential spacing of the vacuum ports from the grippers and tuckers may be variable from at least a first to a second circumferential spacing to accommodate production of interfolded sheets having at least a first partial panel width and sheets having a second partial panel width.

In one form of a dual mode apparatus having variable spacing of the vacuum ports, the vacuum ports are defined by plates which are alternatively attachable to the rolls, for changing the circumferential spacing of the vacuum ports with respect to the grippers and tuckers.

When a dual mode apparatus, according to the invention, is providing sheets having sheets of porous material with the leading panel having a partial panel width, the control arrangement is further configured and operatively connected to remove vacuum from the vacuum port holding both the leading edge of the leading panel of a given sheet and an underlying portion of the trailing panel of the immediately previous sheet against the periphery of the roll downstream from the nip, at a desired angular position beyond the nip in the direction of rotation of the vacuum port holding both the leading edge of the leading panel of a given sheet and an underlying portion of the trailing panel of the immediately previous sheet against the periphery of the roll downstream from the nip.

When providing sheets having a partial width leading panel, the control arrangement for a dual mode apparatus may selectively apply and remove vacuum from the vacuum ports of the folding rolls in such a manner that the leading edges of the sheets are held directly against the periphery of one or the other of the folding rolls upstream from the nip, and are then transferred to the other of the one or the other folding rolls substantially as corresponding vacuum ports in the first and second folding rolls pass through the nip in substantial juxtaposition to one another, by the process of:

(a) removing vacuum from the one or the other of the folding rolls to release the leading edge from the periphery of the one or the other of the folding rolls, substantially as corresponding vacuum ports in the first and second folding rolls pass through the nip in substantial juxtaposition to one another; and then (b) supplying sufficient vacuum to the vacuum port in the other of the one or the other folding rolls for holding both the leading edge of the leading panel of a given sheet and an underlying portion of the trailing panel of the immediately previous sheet against the periphery of the other of the one or the other folding rolls downstream from the nip.

Other aspects, objects and advantages of the invention will be apparent from the following detailed description and accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention.

DETAILED DESCRIPTION OF THE INVENTION

Figure 3:
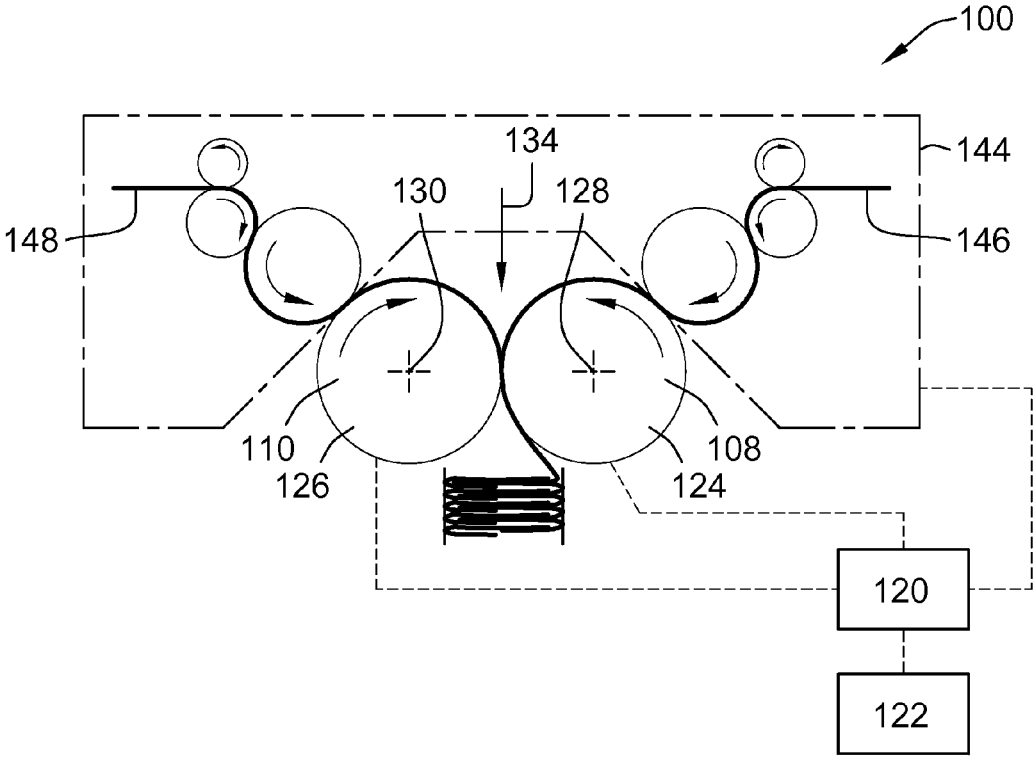
FIG. 3 is a schematic illustration of a first exemplary embodiment of an interfolding apparatus, according to the invention, for providing an interfolded stack of porous sheets of material having a full-width trailing panel joined to a partial-width leading panel in the manner illustrated in FIG. 2.
Figure 4:
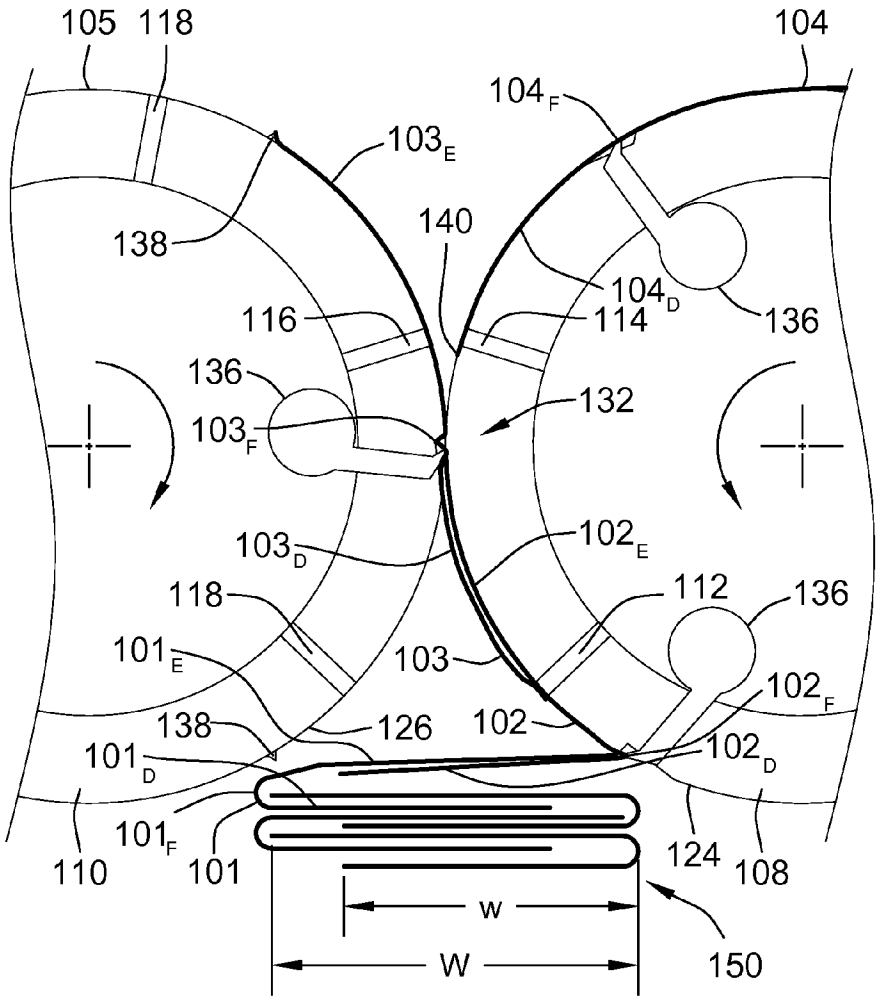
FIGS. 4 and 5 are enlarged schematic illustrations of a portion of the first exemplary embodiment of the interfolding apparatus, according to the invention, shown in FIG. 3, with FIGS. 4 and 5 sequentially illustrating the manner in which successive sheets are folded by the interfolding apparatus.
Figure 5:
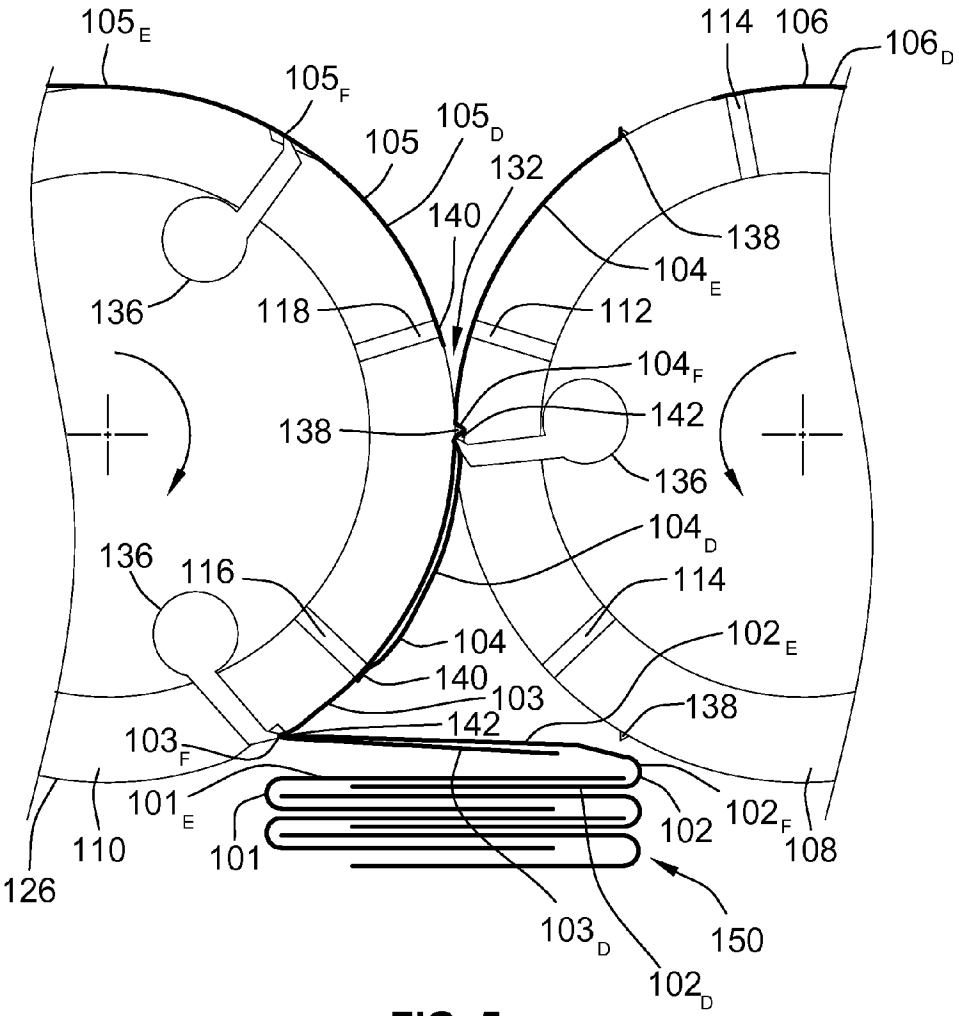

FIGS. 3-5 show a first exemplary embodiment of an apparatus 100 for interfolding a succession of sheets 101, 102, 103, 104, 105, 106, each having a leading panel $\mathbf{101}_D$, $\mathbf{102}_D$, $\mathbf{103}_D$, $\mathbf{104}_D$, $\mathbf{105}_D$, $\mathbf{106}_D$, and a trailing panel $\mathbf{101}_E$, $\mathbf{102}_E$, $\mathbf{103}_E$, $\mathbf{104}_E$, $\mathbf{105}_E$, $\mathbf{106}_E$, joined to one another along a fold line $\mathbf{101}_F$, $\mathbf{102}_F$, $\mathbf{103}_F$, $\mathbf{104}_F$, $\mathbf{105}_F$, $\mathbf{106}_F$, with the sheets being folded such that the trailing panel defines a full-panel width W and a leading panel having a partial-panel width w that is less than the full-panel width W.

The first exemplary embodiment of the interfolding apparatus 100 includes first and second folding rolls 108, 110 each having vacuum ports 112, 114, 116, 118 and a control arrangement 120 (represented by box 120 in FIG. 3 and a series of dashed lines connecting the box 120 to other components in the apparatus 100) for selectively controlling application of vacuum from a source of vacuum 122 to the vacuum ports 112, 114, 116, 118.

The first and second folding rolls 108, 110 define respective peripheries 124, 126 thereof, and are mounted for counter-rotation about respective substantially parallel first and second roll axes 128, 130 to form a nip 132 between the rolls 108, 110 for passage therethrough of the sheets 101, 102, 103, 104, 105, 106 (i.e. 101-106) along a sheet path (represented in FIG. 3 by arrow 134) with the sheet path 134 extending through the nip 132.

Each of the first and second folding rolls 108, 110 includes a plurality of grippers 136 and tuckers 138 alternatingly circumferentially spaced from one another at a circumferential distance W from one another substantially equal to the full-panel width W. The folding rolls 108, 110 are operatively connected for counter-rotation in a timed relationship to one another such that the grippers 136 from each roll 108, 110 interface cooperatively with respective tuckers 138 from the other roll 108, 110 at the nip 32, in the manner illustrated in FIGS. 4 and 5.

The vacuum ports 114 in the first roll 108 and 118 in the second roll 110 are disposed in the periphery of their respective folding rolls 108, 110 at a circumferential distance w substantially equal to the partial-panel length w ahead of each gripper 136. The vacuum ports 112 in the first roll 108 and 116 in the second roll 110 are disposed in the periphery of their respective folding rolls at a circumferential distance w substantially equal to the partial-panel length w ahead of each tucker 138. The vacuum ports 112, 114, 116, 118, are all operatively connected to the control arrangement 120 via internal passages (not shown) extending through the folding rolls 108, 110 in any appropriate manner, as is known in the art. In practicing the invention, the control arrangement may also include various types of manifolding arrangements (not shown) for selectively establishing fluid communication between the vacuum source 122 and the vacuum ports 112, 114, 116, 118 in any appropriate manner known in the art.

As schematically illustrated in FIG. 3, the first exemplary embodiment of the interfolding apparatus 100 also includes a sheet cutting and feeding arrangement 144 operatively disposed upstream from the folding rolls 108, 110 for alternately feeding sheets from a first and second web of porous material 146, 148 to the folding rolls 108, 110 in such a manner that the successive sheets 101-106 overlap one another by a distance substantially equal to the partial-panel width w. In the first exemplary embodiment of the invention, the sheet cutting and feeding arrangement 144 provides sheets having an overall width equal to the sum of the full-panel width and the partial-panel width (i.e. W+w). Although the cutting and feeding arrangement 144 illustrated in FIG. 3 shows conventional cutting and anvil rolls, it will be understood that the invention may be practiced in other embodiments with a wide variety of cutting and feeding arrangements, as known in the industry.

Operation of the first exemplary embodiment of the interfolding apparatus 100, according to the invention, will now be described with reference specifically to FIGS. 4 and 5 which successively illustrate the passage of sheets 103 and 104 through the nip 132.

As shown in FIGS. 4 and 5, the control arrangement 120 is configured and operatively connected for selectively applying vacuum to, and removing vacuum from, the vacuum ports 112, 114, 116, 118, in such a manner that the leading edge 140 of the leading panel D of each sheet (as illustrated by sheet 104 in FIGS. 4 and 5) is first held directly against the periphery 124 of the first folding roll 108 by a vacuum port 114 disposed ahead of a gripper 136, as the leading edge 140 of the leading panel $\mathbf{104}_D$ of sheet 104 approaches the nip 132. As will be understood from FIG. 4, the vacuum ports 114 in the first roll 108 will arrive at the nip 132 at the same time and in a substantially juxtaposed relation to the ports 116 in the second roll, which are spaced at the partial panel distance w from the tuckers 138 of the second roll 110, by virtue of the timed rotational relationship of the first and second rolls being such that a gripper from one roll always arrives at the nip at the same time, substantially, as a tucker from the other roll.

As the leading edge 140 of the sheet 104 passes through the nip, the control arrangement 120 is configured and operatively connected to control the application of vacuum to the juxtaposed vacuum ports 114, 116 in such a manner that the leading edge 140 of the sheet 104 is transferred from being held directly against the outer periphery 124 of the first roll 108 to being held by vacuum applied to the corresponding vacuum port 116 in the second roll 110 so in such a way that the leading edge 140 of the sheet 104 is held against a radially outer surface of an underlying trailing panel $\mathbf{103}_E$ of the sheet 103 which immediately preceded the sheet 104 through the nip 132. As illustrated in FIG. 5, the leading edge 140 of the sheet 104 is held against the radially outer surface of the underlying trailing panel 103 which is resting directly on the periphery 126 of the second folding roll 110 as the leading edge 140 approaches and reaches the nip 132.

It will be understood that the word "juxtaposed" as used herein with regard to alignment of the vacuum ports 114, 116 in the first and second folding rolls 108, 110 is intended to convey that the vacuum ports 114, 116 are generally aligned in a region close to the nip 132. In actual practice, it may desirable to transfer the leading edge 140 from one roll to the other at the nip 132, or slightly upstream or downstream from the nip 132 at an angular position of the rolls whereat radial lines extending through the respective vacuum ports to the respective rotational axes 128, 130 of the first and second rolls 108, 110 are not in exact alignment with one another.

It will be further understood by those having skill in the art, that the apparatus and method described herein with regard to the first exemplary embodiments of the interfolding apparatus 100 require that the interfolded sheets be porous enough that the vacuum ports can act through the underlying trailing panel of an immediately preceding sheet resting on the periphery of one of the rolls to hold the leading edge of the next panel in place as the leading edge 140 of the next panel passes through and progresses beyond the nip 140. It will also be recognized that the control arrangement 120 must apply sufficient vacuum for holding the leading edges 140 of the sheets directly against the periphery of one or the other of the folding rolls 108, 110 upstream from the nip, and then have sufficient vacuum applied downstream from the nip for transferring the leading edge 140 to the other of the folding rolls substantially at the point where corresponding vacuum ports 114, 116 or 112, 118 pass through the nip in substantial juxtaposition to one another.

It is contemplated that this process of transferring the leading edges 140 of the sheets may be accomplished by the process including the steps of (first with reference to FIG. 4; (a) removing vacuum from vacuum port 114 in the first folding roll 108 to release the leading edge 140 of the sheet 104 from the periphery 124 of the first folding roll 108, substantially as corresponding vacuum ports 114, 116 in the first and second folding rolls 108, 110 pass through the nip 132 and come into substantial juxtaposition to one another; and then (b) supplying sufficient vacuum to the vacuum port 116 in the second folding roll 110 for holding both the leading edge 140 of the sheet 104 and an underlying portion of the trailing panel $\mathbf{103}_E$ of the immediately previous sheet 103 against the periphery 126 of the second folding roll 110 downstream from the nip.

The control arrangement 120 is further configured and operatively connected to remove vacuum from the vacuum port 116 holding both the leading edge 140 of the sheet 104 and the underlying portion of the trailing panel $\mathbf{103}_E$ of the immediately preceding 103, at a desired angular position beyond the nip 132 in the direction of rotation of the vacuum port 116 holding both the leading edge of the leading panel 104*d* of the sheet 104 and the underlying portion of the trailing panel $\mathbf{103}_E$ of the immediately preceding sheet 103, so that the leading panel 104*e* of the sheet 104 can properly nest into the stack 150 of interfolded sheets downstream from the folding rolls 108, 110 in the manner which may be seen for sheets 101, 102, 103 in FIGS. 4 and 5.

The interfolding process described above is carried out continuously at high speed as successive sheets are fed alternately toward the nip by the folding rolls 108, 110. From the preceding discussion, it will also be understood that, when interfolding off-folded sheets having a full-width trailing panel joined to a partial-width leading panel, the sheets are grasped by the grippers only at the trailing edges 142 and at the fold lines F of the successive sheets, with the leading edges being totally controlled by selective application of vacuum to the vacuum ports 112, 114, 116, 118, by the control arrangement 120.

In some embodiments of the invention, it is desirable to provide an apparatus and method in which the circumferential spacing of the vacuum ports 112, 114, 116, 118, from the grippers and tuckers 136, 138 is variable from at least a first to a second circumferential spacing to accommodate production of interfolded sheets having at least a first partial-panel width $w_1$ and sheets having a second partial-panel width $w_2$.

Figure 6:
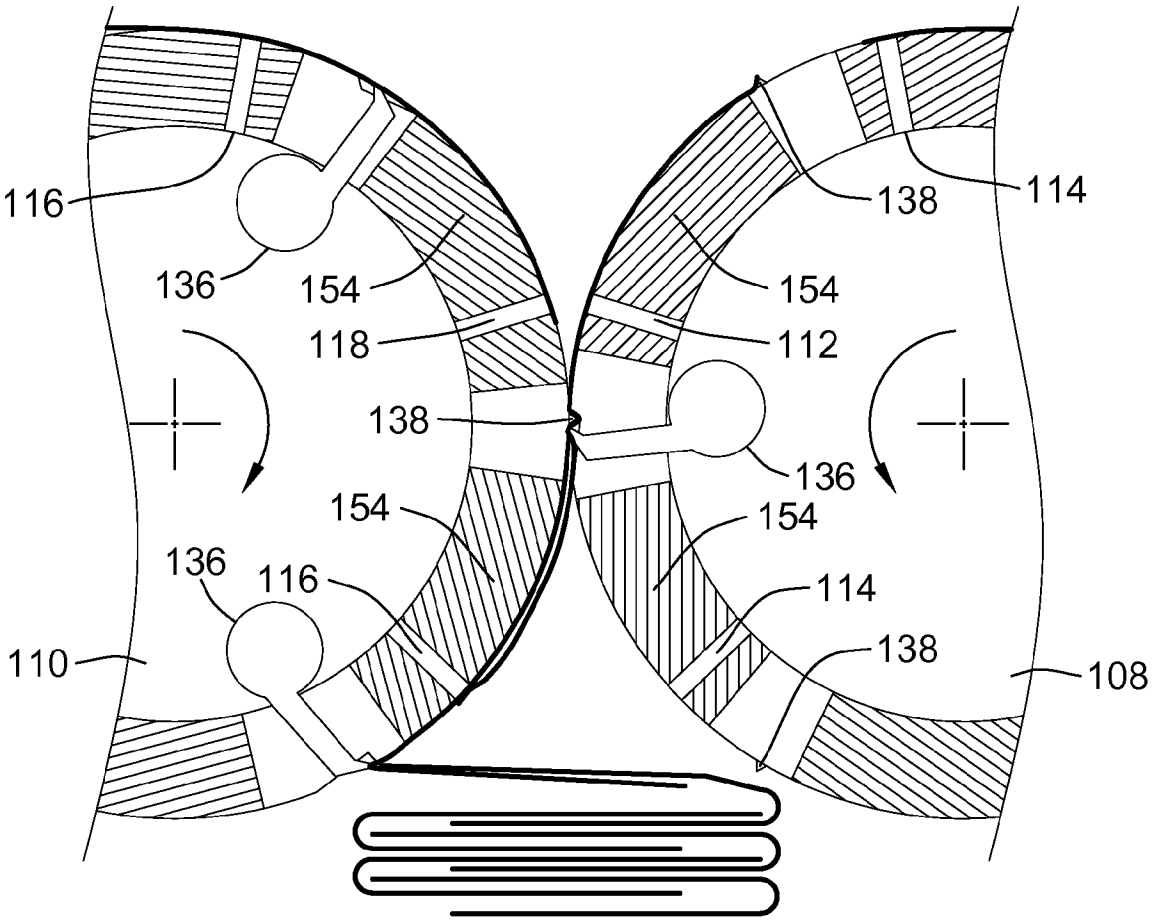
FIG. 6 is a schematic illustration of an embodiment of the invention of the type depicted in FIGS. 3-5, having removable plates attached to the periphery of folding rolls to allow varying the length of the partial-width panel.

As illustrated in FIG. 6, in some embodiments of the invention, provision for varying the circumferential spacing of the vacuum ports 112, 114, 116, 118, from the grippers 136 and tuckers 138 is provided by having the vacuum ports 112, 114, 116, 118 be defined by plates 152 which are alternatively attachable to the rolls 108, 110 for changing the circumferential spacing of the vacuum ports 112, 114, 116, 118 with respect to the grippers 136 and tuckers 138.

To change the spacing of the vacuum ports 112, 114, 116, 118 with respect to the tuckers and grippers 138, 136, a series of plates 154 is provided for each desired first-panel width $w_1$, $w_2$, $w_n$. A set of plates 154 having the desired partial-panel width w is bolted, or otherwise appropriately secured to the first and second rolls 108, 110 to set the interfolding apparatus up for operation with seats having the desired partial-panel width w. It will be understood that the invention is not limited to embodiments having replaceable plates 154. In other embodiments of the invention, any appropriate method and apparatus for changing the location of the vacuum ports 112, 114, 116, 118 may be utilized in practicing the invention.

Figure 7:
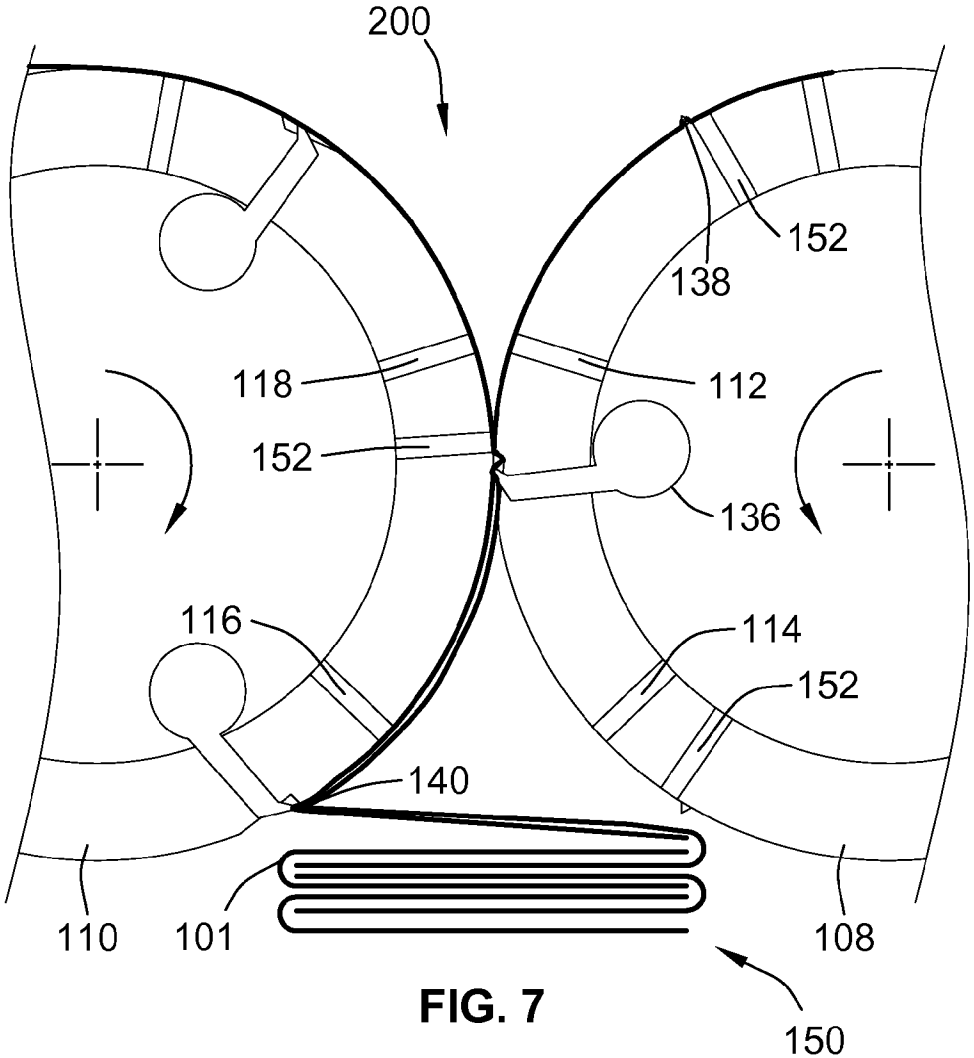
FIG. 7 is a schematic illustration of a second exemplary embodiment of an interfolding apparatus, according to the invention which may be operated in a first mode to provide an interfolded stack of sheets having full-width leading and trailing panels, and may alternatively be operated in a second mode for providing stacks of interfolded sheets of porous material having a full-width trailing panel and a partial-width leading panel.

FIG. 7 illustrates an alternate "dual-mode" embodiment of an interfolding apparatus 200, according to the invention, having a construction substantially similar to the first exemplary embodiment of the interfolding arrangement apparatus 100 described above, and illustrated in FIGS. 3-6, except that in the second exemplary embodiment 200 an additional set of vacuum ports 152 are provided closely adjacent a trailing face of the tuckers 138. It is contemplated that such vacuum ports 152 may be provided in any appropriate form known in the art. For example, the vacuum ports 152 may be provided as part of a resilient tucker element as described in commonly assigned U.S. patent application Ser. No. 12/420,441 to Michler et al.

It is further contemplated that the present invention may be practiced with efficacy in embodiments which do not include the additional vacuum ports 152. Where the sheets being folded are of a thin and flexible nature, however, it is contemplated that the inclusion of such additional vacuum plates 154 may be preferred.

The inclusion of the additional vacuum ports 152 allows the interfolding apparatus 200 to be used in a first "on-fold" mode of operation for providing interfolded stacks of single-folded sheets having both a leading and trailing panel of the full-panel width, or alternatively in a second "off-fold" mode of operation for providing an interfolded stack of single-folded sheets having a full-width trailing panel joined to a partial-width leading panel.

Figure 8:
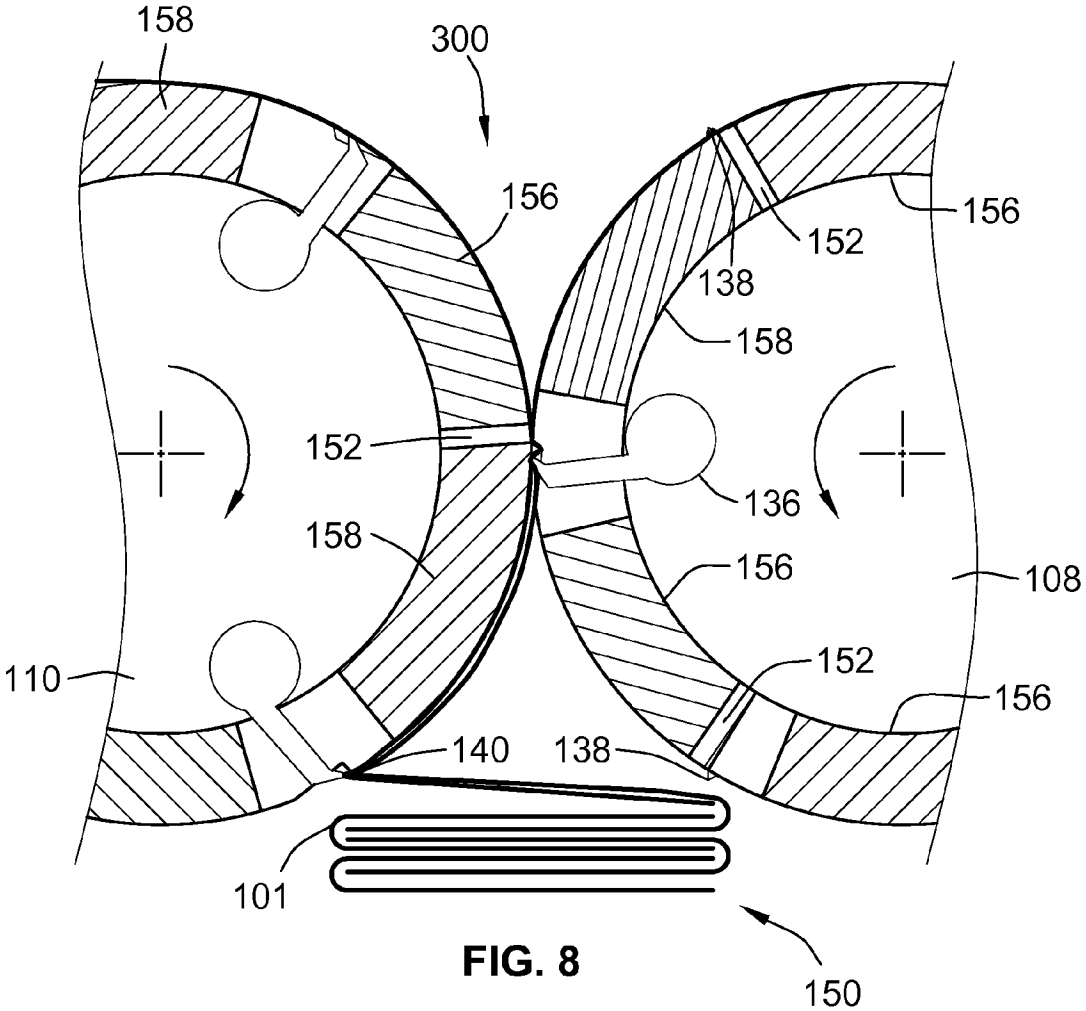
FIGS. 8 and 9 is a schematic illustration of a third exemplary embodiment of the invention which combines aspects of the embodiments shown in FIGS. 6 and 7 wherein removable plates attached to the periphery of the folding rolls are utilized for varying the location of vacuum ports extending through the removable plates in such a manner that, by utilizing plates as illustrated in FIG. 8, an interfolding apparatus, according to the invention may be operated in a first mode to provide an interfolded stacks of sheets having full-width leading and trailing panels, and when equipped with removable plates such as those shown in FIG. 6, the interfolding apparatus may alternatively be operated in a second mode for providing stacks of interfolded sheets of porous material having a full-width trailing panel and a partial-width leading panel, as shown in FIG. 9.

As shown in FIG. 7, when the sheets have two full-width panels, the vacuum ports 112, 114, 116, 118, displaced from the grippers 136 and tuckers 138 at the partial panel circumferential distance are disabled (or removed, as shown in FIG. 8, by replacement with plates 158 having no vacuum ports, for example) and the additional vacuum ports 152 located adjacent the trailing faces of the tuckers 138 are utilized for holding the leading edges 140 of the sheets against the periphery of one of the folding rolls 108 or 110 as the leading edge 140 of the sheet approaches the nip. At the nip, the grippers 136 will grasp a sheet to be folded along its fold line C, together with the leading edge 140 of the next successive sheet and the trailing edge of the trailing panel of the immediately preceding sheet, and fold them all together. Thus, in contrast to the first exemplary embodiment, when an apparatus according to the invention is operated in an on-fold mode, in accordance with the second exemplary embodiment of the interfolding apparatus 200, each sheet is sequentially grasped by the grippers at the leading edge 140, the trailing edge 142 and along its respective fold line F as the sheet travels through the nip.

It will thus be understood that the embodiment depicted in FIG. 7 comprises an apparatus for providing stacks of interfolded sheets having a leading panel and a trailing panel joined at a fold line with the leading and trailing panels both having a full-panel width when operating in the on-fold mode, and alternatively for providing stacks of interfolded sheets of porous material having a leading panel and a trailing panel joined at a fold line with the leading panel having a partial-panel width that is less than the full-panel width when operating in the off-fold mode. With this embodiment 200, it will further be understood that where both the leading and trailing panels have a full-panel width, the apparatus 200 may be utilized for interfolding sheets of non-porous material in addition to sheets of porous material. Where the apparatus 200 is utilized for interfolding sheets having a full-width trailing panel and a partial-width leading panel, however, the sheets must be formed from a porous material so that the vacuum ports 112, 114, 116, 118 may draw the leading edges 140 of the sheets against a portion of the trailing panel of an underlying sheet downstream from the nip 132.

In the second exemplary embodiment of the interfolding apparatus 200, the vacuum ports 112, 114, 116, 118, 152, control arrangement 120 and grippers 136 are selectively configurable and operatively connectable in the manner described above with relation to FIG. 7 such that when the apparatus 200 is operating in the on-fold mode to provide interfolded sheets having leading and trailing panels both equal to the full-panel width, the control arrangement 120 applies vacuum to the vacuum ports 152 located adjacent the trailing face tuckers 138 for holding the leading edge 140 of the leading panels A against the periphery 124 or 126 of the folding rolls 108 or 110 upstream from the nip 132, with the grippers 136 grasping each sheet at the fold line C, the trailing edge 142 and the leading edge 140 thereof.

In the second exemplary embodiment of the interfolding apparatus 200, the vacuum ports 112, 114, 116, 118, 152 and the grippers 136 are further alternatively selectively configurable and operatively connectable such that when the apparatus 200 is operating in the off-fold mode to provide interfolding sheets having the trailing panel E equal to the full-panel width W and the leading panel D equal to the partial-panel width w;

(a) the grippers 136 grasp the sheets 101-106 only at the fold line F and at a trailing edge 142 of the trailing panel E of each sheet 101-106; and (b) the control arrangement 120 selectively applies vacuum to, and removes vacuum from, vacuum ports 112, 114, 116, 118 disposed in the periphery 124, 126 of the first and second folding rolls 108, 110 at a circumferential distance equal to the partial-panel length w ahead of each gripper 136 and tucker 138 in the direction of rotation in such a manner that the leading edge 140 of the leading panel D of each sheet 101-106 is first held directly against the periphery 124, 126 of one or the other of the rolls 108, 110 by a vacuum port disposed ahead of a gripper as the leading edge of the leading panel approaches the nip and is then held by a vacuum port disposed ahead of a tucker 136 of the other roll 108, 110 of the one or the other rolls against a radially outer surface of an underlying trailing panel E of an immediately preceding sheet resting on the periphery of the other roll 108, 110 as the leading edge 140 of the leading panel D moves away from the nip 132.

It will further be understood that when using the second exemplary embodiment of the invention 200 in the off-fold mode to form interfolded stacks of porous material with the leading panel D having a partial panel width w, the control arrangement 120 must be configured and operatively connected to operate as described above with regard to the first exemplary embodiment 100 of the invention to remove vacuum at an appropriate angular position of the vacuum ports 114 and 116 beyond the nip 132 to release the leading edges 140 of the sheets so that they may be properly folded into the stack 150. When operating in this mode, the control arrangement 120 of the second exemplary embodiment of the invention 200 must also selectively apply and remove vacuum from the vacuum ports 112, 114, 116, 118 in the manner described above with regard to the first exemplary embodiment 100 as the corresponding pairs of vacuum ports (112, 118) (114, 116) come into substantial juxtaposition with one another at the nip 132, in order to transfer the leading edge 140 of the sheets from one roll to the other.

Figure 1:
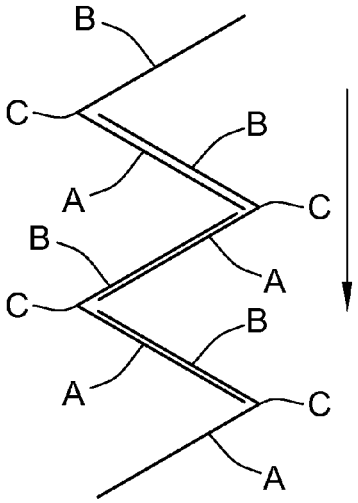
FIG. 1 (PRIOR ART)
FIG. 1 is a schematic illustration of a prior art interfolded stack of single-folded products having two identical full-width panels joined along one side of the panels at a fold line, to thereby provide an on-folded product.
Figure 2:
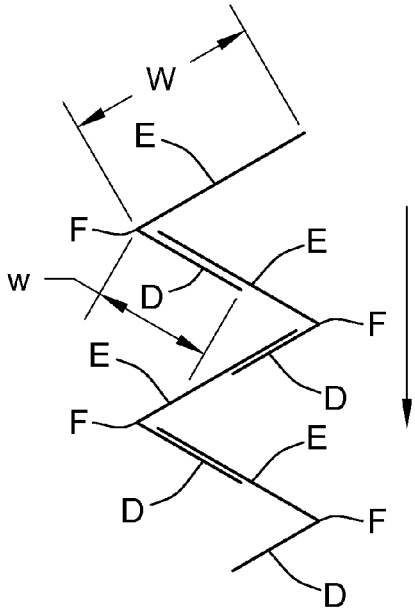
FIG. 2 is a schematic illustration of a stack of interfolded sheets, according to the invention, having a trailing full-width panel joined to a leading partial-width panel along a fold line, to thereby provide an off-folded product.
Figure 9:
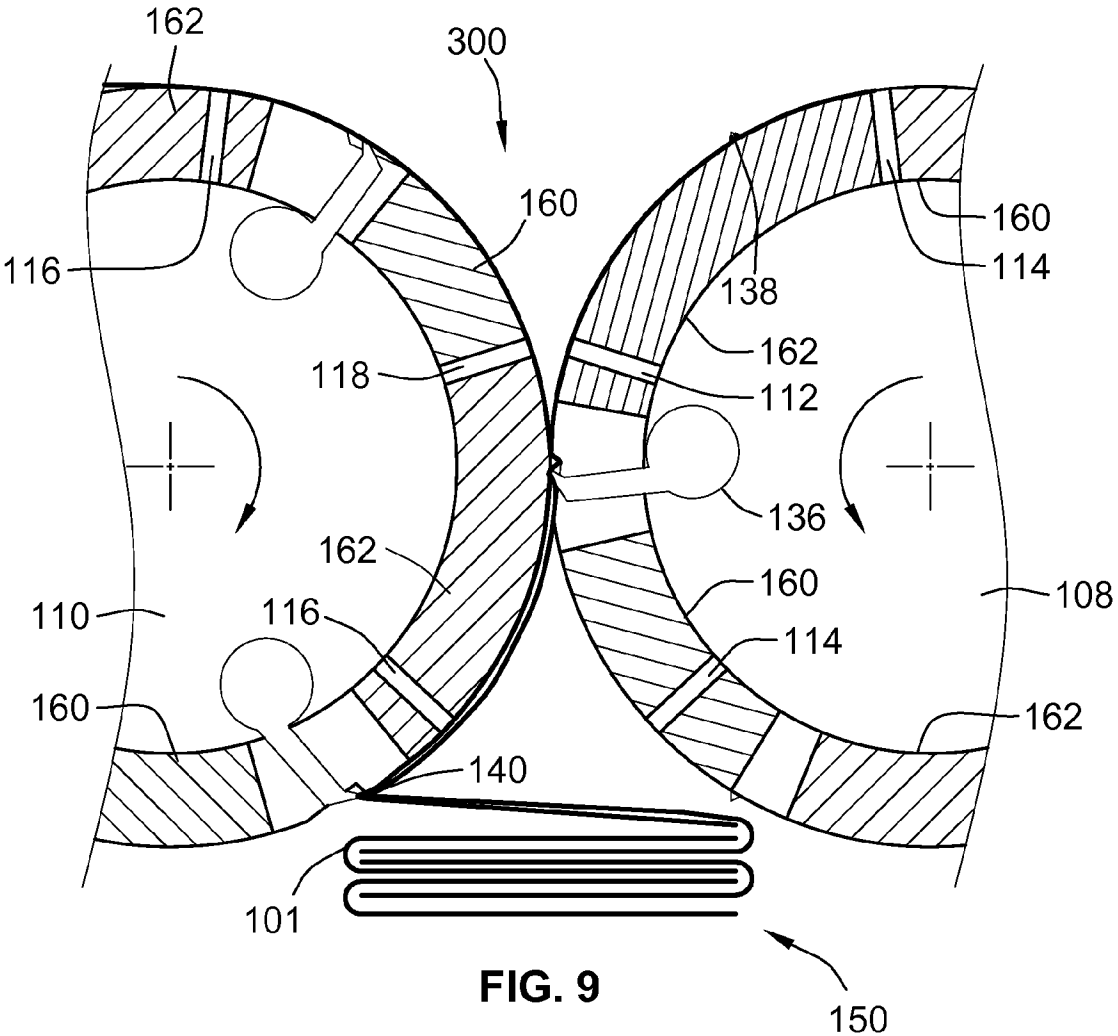

FIGS. 8 and 9 schematically further illustrate a third embodiment of the invention having a first pair of plates 156, 158, as shown in FIG. 8, for operation of the interfolding apparatus 300 in an on-fold mode. Specifically, the plates 156 include vacuum holes 152 located closely adjacent a trailing side of the tuckers 138, for holding the leading edge 140 of a sheet having two full-width panels A, B joined along a common fold line C, in the manner shown in FIG. 1. The plates 158 do not include any vacuum holes in the embodiment shown in FIG. 8, but in some embodiments of the invention may include vacuum holes for other arrangements for holding the trailing end of each sheet against the periphery 124, 126 of one of the rolls 108, 110 adjacent the leading face of the tuckers 138.

FIG. 9 shows the third exemplary embodiment of an interfolding apparatus, according to the invention, configured for off-fold operation. Comparing FIGS. 8 and 9, it will be seen that the plates 156, 158 shown in FIG. 8 have been removed and replaced by another set of plates 160, 162 in FIG. 8. The plates 160, 162 in FIG. 9 include the corresponding vacuum holes 112, 114, 116, 118, needed for operating the third exemplary embodiment 300 in an off-fold mode, in the manner described hereinabove.

Although the exemplary embodiment described hereinabove have all utilized mechanical grippers, and tuckers protruding outward from the periphery of the folding rolls, it will be understood that the invention may be practiced with efficacy using other types of grippers and tuckers known in the art. For example, the grippers do not need to be mechanical. It is contemplated that in some embodiments of the invention vacuum ports may be utilized for performing the functions of the grippers as described herein. In similar fashion, the tuckers may be a vacuum station having a roll or rolls of vacuum ports disposed for holding the trailing edge and/or leading edge of the sheets. It is further contemplated, that in some embodiments of the invention, a tucker and/or gripper arrangement may be recessed below the periphery of the folding rolls.

Experience has shown that an apparatus and/or method according to the invention may be utilized for folding a wide variety of sheet products. For example, the invention may be practiced with sheets having a single ply, or multiple plys forming a single layer, where the ply or layer is not folded prior to passing through the nip. The invention may also be practiced, however, with sheets that have been folded into multiple layers prior to passing through the nip. For example, the sheets may be longitudinally folded prior to entering the nip between the folding rolls. It is also contemplated that the invention may be practiced with sheets that are horizontally folded prior to entering the nip between the folding rolls. Those having skill in the art will recognize that the present invention provides substantial advantage over prior approaches to interfolding successive sheets, by controlling the leading edge of the sheet in such a manner that even single-ply sheets may be folded.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An apparatus for forming a stack of interfolded sheets of porous material including a trailing panel having a full panel width joined along a fold line to a leading panel having a partial panel width that is less than the full panel width, where the sheets define a trailing edge of the trailing panel and a leading edge of the leading panel spaced from the fold line by the full panel width and the partial panel width respectively, the apparatus comprising:

a pair of counter-rotating folding rolls having respective peripheries thereof defining a nip between the rolls and having cooperating grippers and tuckers alternately circumferentially spaced around the peripheries of the rolls at the full panel width with the rolls being operatively connected for counter-rotation in a timed relationship to one another such that the grippers from each roll interface cooperatively with respective tuckers from the other roll at the nip; and a control arrangement configured and operatively connected for positioning the leading edges of the sheets both upstream and downstream from the nip with vacuum applied through corresponding vacuum ports disposed in the periphery of the first and second folding rolls at a circumferential distance equal to the partial panel length ahead of each gripper and tucker in the direction of rotation;

wherein, the control arrangement is further configured and operatively interconnected for positioning the leading edges of the sheets downstream from the nip by applying sufficient suction for holding both the leading edge of the leading panel of a given sheet and an underlying portion of the trailing panel of the immediately previous sheet against the periphery of one or the other of the rolls downstream from the nip.

2. The apparatus of claim 1, wherein, the control arrangement is further configured and operatively interconnected transferring the leading edge to the other roll substantially as corresponding vacuum ports in the first and second folding rolls pass through the nip in substantial juxtaposition to one another, by:

(a) removing vacuum from the one or the other of the folding rolls to release the leading edge from the periphery of the one or the other of the folding rolls, substantially as corresponding vacuum ports in the first and second folding rolls pass through the nip in substantial juxtaposition to one another; and then (b) supplying sufficient vacuum to the vacuum port in the other of the one or the other folding rolls for holding both the leading edge of the leading panel of a given sheet and an underlying portion of the trailing panel of the immediately previous sheet against the periphery of the other of the one or the other folding rolls downstream from the nip.

3. An apparatus for interfolding sheets of porous material fed alternately from two sheet streams to form a stack of interfolded sheets each having a leading panel and a trailing panel joined to one another along a fold line with the sheets being folded such that the trailing panel defines a full panel width and the leading panel has a partial panel width that is less than the full panel width, the apparatus comprising:

first and second folding rolls each having vacuum ports and a control arrangement for selectively controlling application of vacuum to the vacuum ports;

the first and second folding rolls defining respective peripheries thereof and being mounted for rotation about respective substantially parallel first and second roll axes to form a nip between the rolls for passage therethrough of the sheets along a sheet path extending through the nip;

each of the first and second folding rolls having at least one gripper and at least one tucker alternately circumferentially spaced at a circumferential distance from one another substantially equal to the full panel width, with the rolls being operatively connected for counter-rotation in a timed relationship to one another such that the grippers from each roll interface cooperatively with respective tuckers from the other roll at the nip;

the vacuum ports being disposed in the periphery of the first and second folding rolls at a circumferential distance equal to the partial panel length ahead of each gripper and tucker in the direction of rotation;

the control arrangement being configured and operatively connected for selectively applying vacuum to, and removing vacuum from, the vacuum ports in such a manner that the leading edge of the leading panel of each sheet is first held directly against the periphery of one or the other of the rolls by a vacuum port disposed ahead of a gripper as the leading edge of the leading panel approaches the nip and is then held by a vacuum port disposed ahead of a tucker of the other roll of the one or the other rolls against a radially outer surface of an underlying trailing panel of an immediately preceding sheet resting on the periphery of the other roll as the leading edge of the leading panel approaches and then passes through the nip;

the control arrangement applying sufficient vacuum for holding the leading edges of the sheets directly against the periphery of one or the other of the folding rolls upstream from the nip, and then transferring the leading edge to the other of the one or the other folding rolls substantially as corresponding vacuum ports in the first and second folding rolls pass through the nip in substantial juxtaposition to one another, by:

(a) removing vacuum from the one or the other of the folding rolls to release the leading edge from the periphery of the one or the other of the folding rolls, substantially as corresponding vacuum ports in the first and second folding rolls pass through the nip in substantial juxtaposition to one another; and then (b) supplying sufficient vacuum to the vacuum port in the other of the one or the other folding rolls for holding both the leading edge of the leading panel of a given sheet and an underlying portion of the trailing panel of the immediately previous sheet against the periphery of the other of the one or the other folding rolls downstream from the nip.

4. The apparatus of claim 3, wherein, the sheets consist of the leading and trailing panels joined at the fold line.

5. The apparatus of claim 4, wherein, the sheets further consist of a single layer of material.

6. The apparatus of claim 3, wherein, the control arrangement is further configured and operatively connected to remove vacuum from the vacuum port holding both the leading edge of the leading panel of a given sheet and an underlying portion of the trailing panel of the immediately preceding sheet against the periphery of the roll downstream from the nip, at a desired angular position beyond the nip in the direction of rotation of the vacuum port holding both the leading edge of the leading panel of a given sheet and an underlying portion of the trailing panel of the immediately previous sheet against the periphery of the roll downstream from the nip.

7. The apparatus of claim 6, wherein, the circumferential spacing of the vacuum ports from the grippers and tuckers is variable from at least a first to a second circumferential spacing to accommodate production of interfolded sheets having at least a first partial panel width and sheets having a second partial panel width.

8. The apparatus of claim 6, further comprising, a sheet cutting arrangement for feeding the sheets to the interfolding rolls in such a manner that the sheets overlap one another by a distance equal to the partial panel width.

9. The apparatus of claim 8, wherein, the sheet cutting arrangement provides sheets having an overall width equal to the sum of the full panel width and the partial panel width.

10. The apparatus of claim 3, wherein, the circumferential spacing of the vacuum ports from the grippers and tuckers is variable from at least a first to a second circumferential spacing to accommodate production of interfolded sheets having at least a first partial panel width and sheets having a second partial panel width.

11. The apparatus of claim 3, further comprising, a sheet cutting arrangement for feeding the sheets to the interfolding rolls in such a manner that the sheets overlap one another by a distance equal to the partial panel width.

12. The apparatus of claim 11, wherein, the sheet cutting arrangement provides sheets having an overall width equal to the sum of the full panel width and the partial panel width.

13. The apparatus of claim 12, wherein, the sheets further consist of a single layer of material.

14. The apparatus of claim 3, wherein, the grippers are configured and operatively connected for grasping the sheets only at the fold line and at a trailing edge of the trailing panel of each sheet.

15. The apparatus of claim 14, wherein, the control arrangement is further configured and operatively connected to remove vacuum from the vacuum port holding both the leading edge of the leading panel of a given sheet and an underlying portion of the trailing panel of the immediately previous sheet against the periphery of the roll downstream from the nip, at a desired angular position beyond the nip in the direction of rotation of the vacuum port holding both the leading edge of the leading panel of a given sheet and an underlying portion of the trailing panel of the immediately previous sheet against the periphery of the roll downstream from the nip.

16. The apparatus of claim 14, wherein, the circumferential spacing of the vacuum ports from the grippers and tuckers is variable from at least a first to a second circumferential spacing to accommodate production of interfolded sheets having at least a first partial panel width and sheets having a second partial panel width.

17. The apparatus of claim 3, further comprising, a sheet cutting arrangement for feeding the sheets to the interfolding rolls in such a manner that the sheets overlap one another by a distance equal to the partial panel width.

18. The apparatus of claim 17, wherein, the sheet cutting arrangement provides sheets having an overall width equal to the sum of the full panel width and the partial panel width.

19. An apparatus for interfolding sheets of porous material fed alternately from two sheet streams to form a stack of interfolded sheets each having a leading panel and a trailing panel joined to one another along a fold line with the sheets being folded such that the trailing panel defines a full panel width and the leading panel has a partial panel width that is less than the full panel width, the apparatus comprising:

first and second folding rolls each having vacuum ports and a control arrangement for selectively controlling application of vacuum to the vacuum ports;

the first and second folding rolls defining respective peripheries thereof and being mounted for rotation about respective substantially parallel first and second roll axes to form a nip between the rolls for passage therethrough of the sheets along a sheet path extending through the nip;

each of the first and second folding rolls having at least one gripper and at least one tucker alternately circumferentially spaced at a circumferential distance from one another substantially equal to the full panel width, with the rolls being operatively connected for counter-rotation in a timed relationship to one another such that the grippers from each roll interface cooperatively with respective tuckers from the other roll at the nip;

the vacuum ports being disposed in the periphery of the first and second folding rolls at a circumferential distance equal to the partial panel length ahead of each gripper and tucker in the direction of rotation;

the control arrangement being configured and operatively connected for selectively applying vacuum to, and removing vacuum from, the vacuum ports in such a manner that the leading edge of the leading panel of each sheet is first held directly against the periphery of one or the other of the rolls by a vacuum port disposed ahead of a gripper as the leading edge of the leading panel approaches the nip and is then held by a vacuum port disposed ahead of a tucker of the other roll of the one or the other rolls against a radially outer surface of an underlying trailing panel of an immediately preceding sheet resting on the periphery of the other roll as the leading edge of the leading panel approaches and then passes through the nip;

the control arrangement applying sufficient vacuum for holding the leading edges of the sheets directly against the periphery of one or the other of the folding rolls upstream from the nip, and then transferring the leading edge to the other of the one or the other folding rolls substantially as corresponding vacuum ports in the first and second folding rolls pass through the nip in substantial juxtaposition to one another, by:

(a) removing vacuum from the one or the other of the folding rolls to release the leading edge from the periphery of the one or the other of the folding rolls, substantially as corresponding vacuum ports in the first and second folding rolls pass through the nip in substantial juxtaposition to one another; and then (b) supplying sufficient vacuum to the vacuum port in the other of the one or the other folding rolls for holding both the leading edge of the leading panel of a given sheet and an underlying portion of the trailing panel of the immediately previous sheet against the periphery of the other of the one or the other folding rolls downstream from the nip;

wherein the control arrangement is further configured and operatively connected to remove vacuum from the vacuum port holding both the leading edge of the leading panel of a given sheet and an underlying portion of the trailing panel of the immediately preceding sheet against the periphery of the roll downstream from the nip, at a desired angular position beyond the nip in the direction of rotation of the vacuum port holding both the leading edge of the leading panel of a given sheet and an underlying portion of the trailing panel of the immediately previous sheet against the periphery of the roll downstream from the nip;

wherein, the circumferential spacing of the vacuum ports from the grippers and tuckers is variable from at least a first to a second circumferential spacing to accommodate production of interfolded sheets having at least a first partial panel width and sheets having a second partial panel width;

wherein, the vacuum ports are defined by plates which are alternatively attachable to the rolls, for changing the circumferential spacing of the vacuum ports with respect to the grippers and tuckers.

20. An apparatus for interfolding sheets of porous material fed alternately from two sheet streams to form a stack of interfolded sheets each having a leading panel and a trailing panel joined to one another along a fold line with the sheets being folded such that the trailing panel defines a full panel width and the leading panel has a partial panel width that is less than the full panel width, the apparatus comprising:

first and second folding rolls each having vacuum ports and a control arrangement for selectively controlling application of vacuum to the vacuum ports;

the first and second folding rolls defining respective peripheries thereof and being mounted for rotation about respective substantially parallel first and second roll axes to form a nip between the rolls for passage therethrough of the sheets along a sheet path extending through the nip;

each of the first and second folding rolls having at least one gripper and at least one tucker alternately circumferentially spaced at a circumferential distance from one another substantially equal to the full panel width, with the rolls being operatively connected for counter-rotation in a timed relationship to one another such that the grippers from each roll interface cooperatively with respective tuckers from the other roll at the nip;

the vacuum ports being disposed in the periphery of the first and second folding rolls at a circumferential distance equal to the partial panel length ahead of each gripper and tucker in the direction of rotation;

the control arrangement being configured and operatively connected for selectively applying vacuum to, and removing vacuum from, the vacuum ports in such a manner that the leading edge of the leading panel of each sheet is first held directly against the periphery of one or the other of the rolls by a vacuum port disposed ahead of a gripper as the leading edge of the leading panel approaches the nip and is then held by a vacuum port disposed ahead of a tucker of the other roll of the one or the other rolls against a radially outer surface of an underlying trailing panel of an immediately preceding sheet resting on the periphery of the other roll as the leading edge of the leading panel approaches and then passes through the nip;

the control arrangement applying sufficient vacuum for holding the leading edges of the sheets directly against the periphery of one or the other of the folding rolls upstream from the nip, and then transferring the leading edge to the other of the one or the other folding rolls substantially as corresponding vacuum ports in the first and second folding rolls pass through the nip in substantial juxtaposition to one another, by:

(a) removing vacuum from the one or the other of the folding rolls to release the leading edge from the periphery of the one or the other of the folding rolls, substantially as corresponding vacuum ports in the first and second folding rolls pass through the nip in substantial juxtaposition to one another; and then (b) supplying sufficient vacuum to the vacuum port in the other of the one or the other folding rolls for holding both the leading edge of the leading panel of a given sheet and an underlying portion of the trailing panel of the immediately previous sheet against the periphery of the other of the one or the other folding rolls downstream from the nip;

wherein the circumferential spacing of the vacuum ports from the grippers and tuckers is variable from at least a first to a second circumferential spacing to accommodate production of interfolded sheets having at least a first partial panel width and sheets having a second partial panel width; and wherein, the vacuum ports are defined by plates which are alternatively attachable to the rolls, for changing the circumferential spacing of the vacuum ports with respect to the grippers and tuckers.

21. An apparatus for interfolding sheets of porous material fed alternately from two sheet streams to form a stack of interfolded sheets each having a leading panel and a trailing panel joined to one another along a fold line with the sheets being folded such that the trailing panel defines a full panel width and the leading panel has a partial panel width that is less than the full panel width, the apparatus comprising:

first and second folding rolls each having vacuum ports and a control arrangement for selectively controlling application of vacuum to the vacuum ports;

the first and second folding rolls defining respective peripheries thereof and being mounted for rotation about respective substantially parallel first and second roll axes to form a nip between the rolls for passage therethrough of the sheets along a sheet path extending through the nip;

each of the first and second folding rolls having at least one gripper and at least one tucker alternately circumferentially spaced at a circumferential distance from one another substantially equal to the full panel width, with the rolls being operatively connected for counter-rotation in a timed relationship to one another such that the grippers from each roll interface cooperatively with respective tuckers from the other roll at the nip;

the vacuum ports being disposed in the periphery of the first and second folding rolls at a circumferential distance equal to the partial panel length ahead of each gripper and tucker in the direction of rotation;

the control arrangement being configured and operatively connected for selectively applying vacuum to, and removing vacuum from, the vacuum ports in such a manner that the leading edge of the leading panel of each sheet is first held directly against the periphery of one or the other of the rolls by a vacuum port disposed ahead of a gripper as the leading edge of the leading panel approaches the nip and is then held by a vacuum port disposed ahead of a tucker of the other roll of the one or the other rolls against a radially outer surface of an underlying trailing panel of an immediately preceding sheet resting on the periphery of the other roll as the leading edge of the leading panel approaches and then passes through the nip;

the control arrangement applying sufficient vacuum for holding the leading edges of the sheets directly against the periphery of one or the other of the folding rolls upstream from the nip, and then transferring the leading edge to the other of the one or the other folding rolls substantially as corresponding vacuum ports in the first and second folding rolls pass through the nip in substantial juxtaposition to one another, by:

(a) removing vacuum from the one or the other of the folding rolls to release the leading edge from the periphery of the one or the other of the folding rolls, substantially as corresponding vacuum ports in the first and second folding rolls pass through the nip in substantial juxtaposition to one another; and then (b) supplying sufficient vacuum to the vacuum port in the other of the one or the other folding rolls for holding both the leading edge of the leading panel of a given sheet and an underlying portion of the trailing panel of the immediately previous sheet against the periphery of the other of the one or the other folding rolls downstream from the nip;

wherein the grippers are configured and operatively connected for grasping the sheets only at the fold line and at a trailing edge of the trailing panel of each sheet;

wherein the circumferential spacing of the vacuum ports from the grippers and tuckers is variable from at least a first to a second circumferential spacing to accommodate production of interfolded sheets having at least a first partial panel width and sheets having a second partial panel width;

wherein, the vacuum ports are defined by plates which are alternatively attachable to the rolls, for changing the circumferential spacing of the vacuum ports with respect to the grippers and tuckers.

22. An apparatus for providing stacks of interfolded sheets having a leading panel and a trailing panel joined at a fold line with the leading and trailing panels both having a full panel width, and alternatively for providing stacks of interfolded sheets of porous material having a leading panel and a trailing panel joined at a fold line with the leading panel having a partial panel width that is less than the full panel width, the sheets further defining a leading edge of the leading panel thereof and a trailing edge of the trailing panel thereof regardless of the width of the leading and trailing panels; the apparatus comprising:

first and second folding rolls each having vacuum ports and a control arrangement for selectively controlling application of vacuum to the vacuum ports;

the first and second folding rolls defining respective peripheries thereof and being mounted for rotation about respective substantially parallel first and second roll axes to form a nip between the rolls for passage therethrough of the sheets along a sheet path extending through the nip;

each of the first and second folding rolls having at least one gripper and at least one tucker alternately circumferentially spaced at a circumferential distance from one another substantially equal to the full panel width, with the rolls being operatively connected for counter-rotation in a timed relationship to one another such that the grippers from each roll interface cooperatively with respective tuckers from the other roll at the nip;

the vacuum ports, control arrangement and grippers being selectively configurable and operatively connectable such that when the apparatus is providing interfolded sheets having leading and trailing panels both equal to the full panel width, the control arrangement applies vacuum to vacuum ports located adjacent the tuckers for holding the leading edge of the leading panel against the periphery of the folding rolls upstream from the nip, with the grippers grasping each sheet at the fold line, the trailing edge and the leading edge thereof; and the vacuum ports, control arrangement and grippers being further alternatively selectively configurable and operatively connectable such that when the apparatus is providing interfolded sheets having the trailing panel equal to the full panel width and the leading panel equal to the partial panel width:

(a) the grippers grasp the sheets only at the fold line and at a trailing edge of the trailing panel of each sheet; and (b) the control arrangement selectively applies vacuum to, and removes vacuum from, vacuum ports disposed in the periphery of the first and second folding rolls at a circumferential distance equal to the partial panel length ahead of each gripper and tucker in the direction of rotation in such a manner that the leading edge of the leading panel of each sheet is first held directly against the periphery of one or the other of the rolls by a vacuum port disposed ahead of a gripper as the leading edge of the leading panel approaches the nip and is then held by a vacuum port disposed ahead of a tucker of the other roll of the one or the other rolls against a radially outer surface of an underlying trailing panel of an immediately preceding sheet resting on the periphery of the other roll as the leading edge of the leading panel moves away from the nip.

23. The apparatus of claim 22, wherein, the sheets consist of the leading and trailing panels joined at the fold line.

24. The apparatus of claim 23, wherein, the sheets further consist of a single layer of material.

25. The apparatus of claim 22, wherein, when the apparatus is providing sheets of porous material with the leading panel having a partial panel width, the control arrangement is further configured and operatively connected to remove vacuum from the vacuum port holding both the leading edge of the leading panel of a given sheet and the underlying portion of the trailing panel of the immediately preceding sheet against the periphery of the roll downstream from the nip, at a desired angular position beyond the nip in the direction of rotation of the vacuum port holding both the leading edge of the leading panel of the given sheet and the underlying portion of the trailing panel of the immediately previous sheet against the periphery of the roll downstream from the nip.

26. The apparatus of claim 22, wherein, when the apparatus is providing sheets of porous material with the leading panel having a partial panel width, the control arrangement selectively applies and removes vacuum from the vacuum ports of the folding rolls in such a manner that the leading edges of the sheets are held directly against the periphery of one or the other of the folding rolls upstream from the nip, and are then transferred to the other of the one or the other folding rolls substantially as corresponding vacuum ports in the first and second folding rolls pass through the nip in substantial juxtaposition to one another, by:

(a) removing vacuum from the one or the other of the folding rolls to release the leading edge from the periphery of the one or the other of the folding rolls, substantially as corresponding vacuum ports in the first and second folding rolls pass through the nip in substantial juxtaposition to one another; and then (b) supplying sufficient vacuum to the vacuum port in the other of the one or the other folding rolls for holding both the leading edge of the leading panel of a given sheet and an underlying portion of the trailing panel of the immediately previous sheet against the periphery of the other of the one or the other folding rolls downstream from the nip.

27. The apparatus of claim 26, wherein, when the apparatus is providing sheets having sheets of porous material with the leading panel having a partial panel width, the control arrangement is further configured and operatively connected to remove vacuum from the vacuum port holding both the leading edge of the leading panel of a given sheet and an underlying portion of the trailing panel of the immediately previous sheet against the periphery of the roll downstream from the nip, at a desired angular position beyond the nip in the direction of rotation of the vacuum port holding both the leading edge of the leading panel of a given sheet and an underlying portion of the trailing panel of the immediately previous sheet against the periphery of the roll downstream from the nip.

28. The apparatus of claim 22, wherein, the circumferential spacing of the vacuum ports from the grippers and tuckers is variable from at least a first to a second circumferential spacing to accommodate production of interfolded sheets having at least a first partial panel width and sheets having a second partial panel width.

29. The apparatus of claim 28, wherein, when the apparatus is providing sheets having sheets of porous material with the leading panel having a partial panel width, the control arrangement is further configured and operatively connected to remove vacuum from the vacuum port holding both the leading edge of the leading panel of a given sheet and an underlying portion of the trailing panel of the immediately previous sheet against the periphery of the roll downstream from the nip, at a desired angular position beyond the nip in the direction of rotation of the vacuum port holding both the leading edge of the leading panel of a given sheet and an underlying portion of the trailing panel of the immediately previous sheet against the periphery of the roll downstream from the nip.

30. The apparatus of claim 29, wherein, the control arrangement selectively controls applies and removes vacuum from the vacuum ports of the folding rolls in such a manner that the leading edges of the sheets are held directly against the periphery of one or the other of the folding rolls upstream from the nip, and are then transferred to the other of the one or the other folding rolls substantially as corresponding vacuum ports in the first and second folding rolls pass through the nip in substantial juxtaposition to one another, by:

(a) removing vacuum from the one or the other of the folding rolls to release the leading edge from the periphery of the one or the other of the folding rolls, substantially as corresponding vacuum ports in the first and second folding rolls pass through the nip in substantial juxtaposition to one another; and then (b) supplying sufficient vacuum to the vacuum port in the other of the one or the other folding rolls for holding both the leading edge of the leading panel of a given sheet and an underlying portion of the trailing panel of the immediately previous sheet against the periphery of the other of the one or the other folding rolls downstream from the nip.

31. An apparatus for providing stacks of interfolded sheets having a leading panel and a trailing panel joined at a fold line with the leading and trailing panels both having a full panel width, and alternatively for providing stacks of interfolded sheets of porous material having a leading panel and a trailing panel joined at a fold line with the leading panel having a partial panel width that is less than the full panel width, the sheets further defining a leading edge of the leading panel thereof and a trailing edge of the trailing panel thereof regardless of the width of the leading and trailing panels; the apparatus comprising:

first and second folding rolls each having vacuum ports and a control arrangement for selectively controlling application of vacuum to the vacuum ports;

the first and second folding rolls defining respective peripheries thereof and being mounted for rotation about respective substantially parallel first and second roll axes to form a nip between the rolls for passage therethrough of the sheets along a sheet path extending through the nip;

each of the first and second folding rolls having at least one gripper and at least one tucker alternately circumferentially spaced at a circumferential distance from one another substantially equal to the full panel width, with the rolls being operatively connected for counter-rotation in a timed relationship to one another such that the grippers from each roll interface cooperatively with respective tuckers from the other roll at the nip;

the vacuum ports, control arrangement and grippers being selectively configurable and operatively connectable such that when the apparatus is providing interfolded sheets having leading and trailing panels both equal to the full panel width, the control arrangement applies vacuum to vacuum ports located adjacent the tuckers for holding the leading edge of the leading panel against the periphery of the folding rolls upstream from the nip, with the grippers grasping each sheet at the fold line, the trailing edge and the leading edge thereof; and the vacuum ports, control arrangement and grippers being further alternatively selectively configurable and operatively connectable such that when the apparatus is providing interfolded sheets having the trailing panel equal to the full panel width and the leading panel equal to the partial panel width:

(a) the grippers grasp the sheets only at the fold line and at a trailing edge of the trailing panel of each sheet; and (b) the control arrangement selectively applies vacuum to, and removes vacuum from, vacuum ports disposed in the periphery of the first and second folding rolls at a circumferential distance equal to the partial panel length ahead of each gripper and tucker in the direction of rotation in such a manner that the leading edge of the leading panel of each sheet is first held directly against the periphery of one or the other of the rolls by a vacuum port disposed ahead of a gripper as the leading edge of the leading panel approaches the nip and is then held by a vacuum port disposed ahead of a tucker of the other roll of the one or the other rolls against a radially outer surface of an underlying trailing panel of an immediately preceding sheet resting on the periphery of the other roll as the leading edge of the leading panel moves away from the nip;

wherein, the circumferential spacing of the vacuum ports from the grippers and tuckers is variable from at least a first to a second circumferential spacing to accommodate production of interfolded sheets having at least a first partial panel width and sheets having a second partial panel width;

wherein, the vacuum ports are defined by plates which are alternatively attachable to the rolls, for changing the circumferential spacing of the vacuum ports with respect to the grippers and tuckers.

32. A method for using an apparatus, including a pair of counter-rotating folding rolls having respective peripheries thereof defining a nip between the rolls and having cooperating grippers and tuckers alternately circumferentially spaced around peripheries of the rolls at the full panel width with the rolls being operatively connected for counter-rotation in a timed relationship to one another such that the grippers from each roll interface cooperatively with respective tuckers from the other roll at the nip, to form a stack of interfolded sheets of porous material including a trailing panel having a full panel width joined along a fold line to a leading panel having a partial panel width that is less than the full panel width, where the sheets define a trailing edge of the trailing panel and the sheet and a leading edge of the leading panel and the sheet spaced from the fold line by the full panel width and the partial panel width respectively, the method comprising:

positioning, using a control arrangement, the leading edges of the sheets both upstream and downstream from the nip with vacuum applied through corresponding vacuum ports disposed in the periphery of the first and second folding rolls at a circumferential distance equal to the partial panel length ahead of each gripper and tucker in the direction of rotation;

configuring and operatively interconnecting the control arrangement for positioning the leading edges of the sheets downstream from the nip by applying sufficient suction for holding both the leading edge of the leading panel of a given sheet and an underlying portion of the trailing panel of the immediately previous sheet against the periphery of one or the other of the rolls downstream from the nip.

* * * * *